US012385236B2

(12) United States Patent
Lee

(10) Patent No.: US 12,385,236 B2
(45) Date of Patent: Aug. 12, 2025

(54) FAUCET ASSEMBLY AND A BUSHING THEREOF

(71) Applicant: Wei-Yao Lee, Changhua (TW)

(72) Inventor: Wei-Yao Lee, Changhua (TW)

(73) Assignee: SONG-JYI ENTERPRISE CORP., Changhua County (TW)

( * ) Notice: Subject to any disclaimer, the term of this patent is extended or adjusted under 35 U.S.C. 154(b) by 218 days.

(21) Appl. No.: 18/119,273

(22) Filed: Mar. 8, 2023

(65) Prior Publication Data

US 2024/0301669 A1 Sep. 12, 2024

(51) Int. Cl.
*E03C 1/04* (2006.01)

(52) U.S. Cl.
CPC ..... *E03C 1/0403* (2013.01); *E03C 1/0402* (2013.01); *E03C 2201/30* (2013.01)

(58) Field of Classification Search
CPC ..... E03C 1/0403
See application file for complete search history.

(56) References Cited

U.S. PATENT DOCUMENTS

| | | | | |
|---|---|---|---|---|
| 7,373,674 | B1 * | 5/2008 | Condon | E03C 1/042 285/902 |
| 9,790,667 | B2 * | 10/2017 | Du | F16K 3/0254 |
| 12,065,811 | B2 * | 8/2024 | Ghiglieri | E03C 1/0402 |
| 2012/0266989 | A1 * | 10/2012 | Huang | E03C 1/042 137/798 |
| 2017/0275857 | A1 * | 9/2017 | DiDea | E03C 1/023 |

* cited by examiner

*Primary Examiner* — Christine J Skubinna

(57) ABSTRACT

A faucet assembly and a bushing thereof are described. The faucet assembly comprises a case, a drain tube and a bushing. The drain tube is assembled in the case. The drain tube has a first opening and a second opening extending coaxially from the first opening. The bushing set is at the first opening of the drain tube. The bushing is assembled to a water pipe extending from a wall. The case has an exit at a front end thereof. The second opening of the drain tube is connected to the exit. The bushing comprises a main body. The main body has a through opening formed therethrough to be assembled to a water pipe. The main body further comprises a water-inlet portion, a water-outlet portion, and a protruding portion between the water-inlet portion and the water-outlet portion. The protruding portion is thicker than both of the water-inlet portion and the water-outlet portion of the main body. The water-outlet portion has an outer surface and an inner surface.

16 Claims, 7 Drawing Sheets

FAUCET ASSEMBLY AND A BUSHING THEREOF

BACKGROUND

Field of Invention

The present invention relates generally to a faucet, and, more specifically, to a faucet assembly and a bushing thereof.

Description of Related Art

Usually, a faucet is assembled to a wall so as to connect to a water pipe on the wall. However, the water pipes in the area have various types. If the faucet is not suitable for the water pipe, the faucet would not be able to connect to the water pipe.

The present invention is, therefore, arisen to obviate or at least mitigate the above mentioned disadvantages.

SUMMARY OF THE INVENTION

According to one aspect of the present disclosure, a bushing is provided. The bushing is set at a drain tube. The bushing comprises a main body. The main body has a through opening formed therethrough to be assembled to a water pipe. The main body further comprises a water-inlet portion, a water-outlet portion, and a protruding portion between the water-inlet portion and the water-outlet portion. The protruding portion is thicker than both of the water-inlet portion and the water-outlet portion of the main body. The water-outlet portion has an outer surface and an inner surface. The bushing further comprises a first slope between the water-inlet portion and the protruding portion. The bushing further comprises a second slope between the water-outlet portion and the protruding portion. The bushing further comprises a first ring groove formed in the outer surface of the water-outlet portion. The bushing further comprises a first ring member positioned in the first ring groove. The bushing further comprises a second ring groove formed in the inner surface of the water-outlet portion. The bushing further comprises a second ring member positioned in the second ring groove. The drain tube has a first opening and a second opening extending coaxially from the first opening. The busing is set at the first opening of the drain tube. The first opening is larger in diameter that the second opening of the drain tube. The bushing further comprises a step portion defined between the first opening and the second opening. The water-outlet portion of the main body is adjacent to the step portion. The first opening has an inner side adjacent to the step portion. The first ring member is adjacent to the inner side of the first opening.

According to one aspect of the present disclosure, a faucet assembly is provided. The faucet assembly comprises a case, a drain tube and a bushing, the drain tube assembled in the case, the drain tube having a first opening and a second opening extending coaxially from the first opening, the bushing set at the first opening of the drain tube, the bushing assembled to a water pipe extending from a wall, the case having an exit at a front end thereof, the second opening of the drain tube connected to the exit.

The bushing comprises a main body having a through opening formed therethrough to be assembled to a water pipe, the main body comprising a water-inlet portion, a water-outlet portion, and a protruding portion between the water-inlet portion and the water-outlet portion. The water-outlet portion having an outer surface and an inner surface. The faucet assembly further comprises a threaded hole formed on the water-inlet portion of the main body. The protruding portion is thicker than both of the water-inlet portion and the water-outlet portion of the main body. The water-outlet portion and the water-inlet portion have the same thickness. The protruding portion is thicker than both of the water-inlet portion and the water-outlet portion of about 3.6 mm. The faucet assembly further comprises a knob 17 being movable to control an on-off state of the drain tube.

Other objects, advantages, and novel features of the invention will become more apparent from the following detailed description when taken in conjunction with the accompanying drawings.

The present invention will become more obvious from the following description when taken in connection with the accompanying drawings, which show, for purpose of illustrations only, the preferred embodiment(s) in accordance with the present invention.

DETAILED DESCRIPTION

Figure 1:
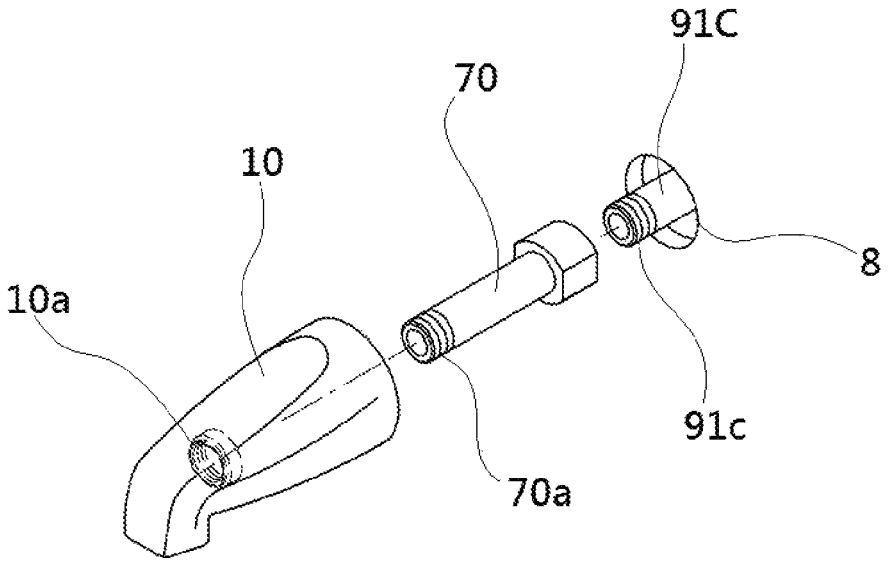
FIG. 1 is a three-dimensional schematic diagram of a faucet assembly according to a first preferred embodiment of the present invention.

Plural embodiments of the present disclosure are disclosed through drawings. For the purpose of clear illustration, many practical details will be illustrated along with the description below. It should be understood that, however, these practical details should not limit the present disclosure. In other words, in embodiments of the present disclosure, these practical details are not necessary. In addition, for the purpose of simplifying the drawings, some conventional structures and components are simply and schematically depicted in the figures.

It is to be understood that although particular phrases used herein, such as "first", "second", "third", and so on, are used to describe different components, members, regions, layers, and/or sections, these components, members, regions, layers, and/or sections should not be limited by these terms. These phrases are used to distinguish one component, member, region, layer, or section from another component, member, region, layer, or section. In this way, a first component, member, region, layer, and/or section to be described below may be referred to as a second component, member, region, layer, and/or section, without departing from the spirit and scope of the present disclosure.

Spatially relative phrases, such as "onto", "on", "over", "under", "below", "underlying", "beneath", "above", and so on used herein, are used for facilitating description of a relation between one component or feature and another component or feature depicted in the drawings. Therefore, it can be understood that, in addition to directions depicted in the drawings, the spatially relative terms mean to include all different orientations during usage or operations of the device. For example, it is assumed that a device in a figure is reversed upside down, a component described as being "under", "below", or "beneath" another component or feature is oriented "onto" or "on" the other component or feature. Therefore, these exemplary terms "under" and "below" may include orientations above and below. The device may be otherwise oriented (e.g., turned by 90 degrees, or other orientations), and the spatially relative terms used herein should be explained accordingly.

Accordingly, it may be understood that when a component or a layer is referred to as being "onto", "on", "connected to", or "coupled to" another component or another layer, it may be immediately on the other component or layer, or connected to or coupled to the other component or layer, or there may be one or more intermediate components or intermediate layers. Further, it can be understood that when a component or a layer is referred to as being "between" two components or two layers, it may be the only component or layer between the two components or layers, or there may be one or more intermediate components or intermediate layers.

Terminologies used herein are only for the purpose of describing particular embodiments, but not limiting the present disclosure. The singular form of "a" and "the" used herein may also include the plural form, unless otherwise indicated in the context. Accordingly, it can be understood that when there terms "include" or "comprise" are used in the specification, it clearly illustrates the existence of a specified feature, bulk, step, operation, component, and/or member, while not excluding the existence or addition of one or more features, bulks, steps, operations, components, members and/or groups thereof. "And/or" used herein includes any and all combinations of one or more related terms that are listed. When a leading word, such as "at least one of", is added ahead of a component list, it is to describe the entire component list, but not individual components among the lists.

Unless otherwise specified, in the description of the present invention, it should be noted that "at" "assembled to", "adjacent to" "positioned in", "formed in", "between", "extending coaxially from", "extending from", "on", "in", "connected" should be understood in a broad sense, for example, a detachable connection, a fixed connection, an integrally formed connection, or an integrally formed, mechanical connection or electrical connection. It can be directly connected or indirectly connected through an intermediate. It can be the internal communication of two components. One of ordinary skill in the field may understand the specific meanings of the above terms in the present invention.

FIG. 1 is a three-dimensional schematic diagram of a faucet assembly according to a first preferred embodiment of the present invention. Referring to FIG. 1, the faucet assembly of the invention comprises a case 10 and a drain tube 70. The drain tube 70 may be assembled in the case 10. The material of the drain tube 70 is, for example, polyoxymethylene (POM for short).

Referring to FIG. 1, the faucet assembly may further comprise a female thread 10*a* formed at a front end of the case 10. The faucet assembly may further comprise a male thread 70*a* may be formed at an end of the drain tube 70. The female thread 10*a* of the case 10 may be screwed to the male thread 70*a* of the drain tube 70. A water pipe 91C may be assembled in the drain tube 70. The length of water pipe 91C outside the wall 8 may be, for example, about ½ inches. A male thread 91*c* may be formed at an end of the water pipe 91C. The water pipe 91C may have a size of about ¾ inches. The female thread 10*a* of the water pipe 91C may be screwed to the male thread 91*c* of the drain tube 70.

Figure 2:
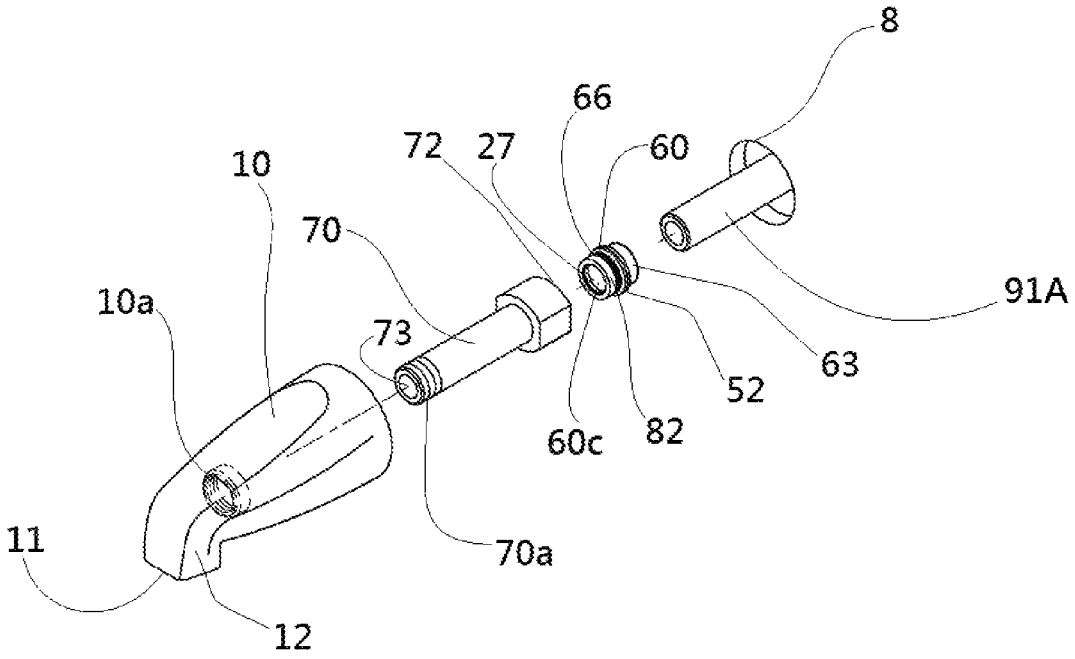
FIG. 2 is a three-dimensional schematic diagram of a faucet assembly according to a second preferred embodiment of the present invention.

FIG. 2 is a three-dimensional schematic diagram of a faucet assembly according to a second preferred embodiment of the present invention. Referring to FIG. 2, the faucet assembly may comprise a case 10, a drain tube 70, and a bushing 60. The drain tube 70 may be assembled in the case 10. The drain tube 10 may have a first opening 72 and a second opening 73 extending coaxially from the first opening 72. The first opening 72 may be larger in diameter that the second opening 73 of the drain tube 70. The bushing 60 may be set at the first opening 72 of the drain tube. The bushing 60 may be assembled to a water pipe 91B extending from a wall 8. The case 10 may have an exit 11 at a front end 12 thereof.

Referring to FIG. 2, the faucet assembly may further comprise a female thread 10*a* formed at a front end of the case 10. the faucet assembly may further comprise a male thread 70*a* may be formed at an end of the drain tube 70. The female thread 10*a* of the case 10 may be screwed to the male thread 70*a* of the drain tube 70. The second opening 73 of the drain tube 70 may be connected to the exit 11 by screwing the female thread 10*a* of the case to the male thread 70*a* of the drain tube 70. The bushing 60 may be assembled in the first opening 72 of the drain tube 70. The material of the bushing 60 may be, for example, aluminum (Al).

Referring to FIG. 2, a water pipe 91A may be assembled in the drain tube 70. The length of the water pipe 91A outside the wall 8 may be, for example, about 1-2 inches. The water pipe 91A may have a size of about ½ inches. The water pipe 91A may be assembled in the bushing 60. The bushing 60 may be assembled to the water tube 91A and surrounded by the first opening 72 of the drain tube 70.

Figure 2A:
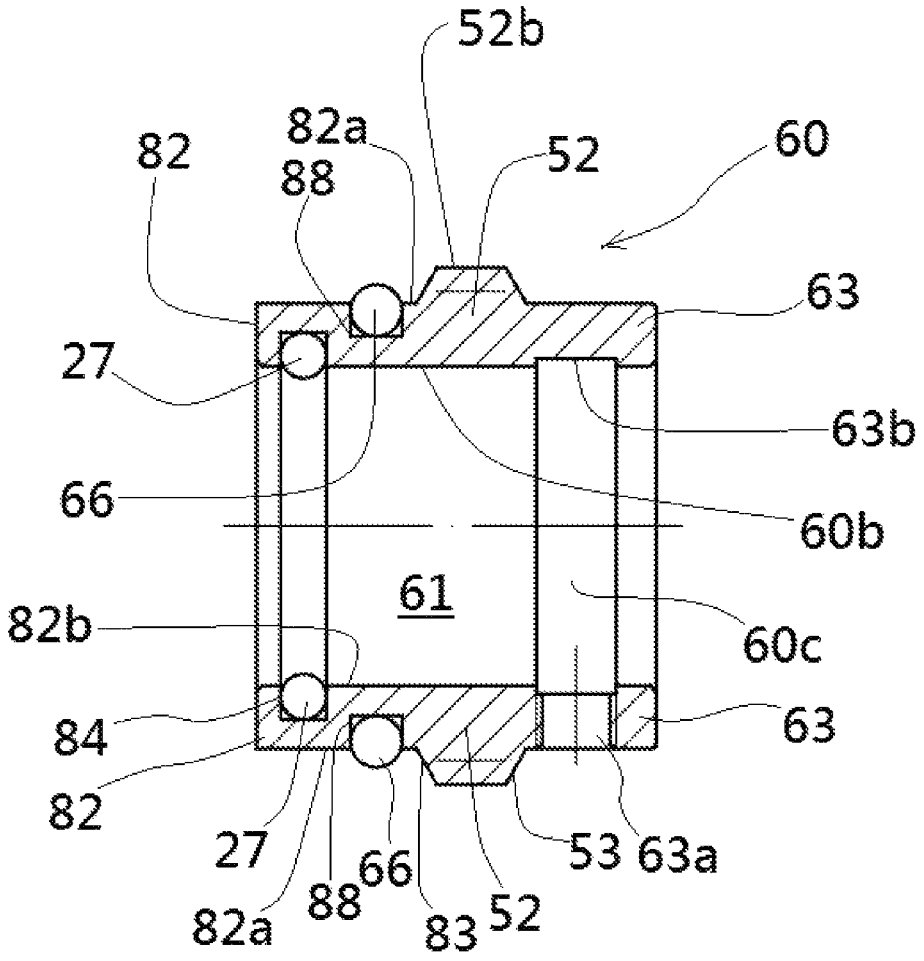
FIG. 2A is a schematic cross-sectional view of a bushing according to the second preferred embodiment of the present invention.

FIG. 2A is a schematic cross-sectional view of a bushing according to the second preferred embodiment of the present invention. Referring to FIG. 2 and FIG. 2A, the bushing 60 may comprise a main body having a through opening 60*c* formed therethrough to be assembled to the water pipe 91A. The main body 61 may comprise a water-inlet portion 63, a water-outlet portion 82, and a protruding portion 52 between the water-inlet portion 63 and the water-outlet portion 82. The protruding portion 52 is not threaded.

Referring to FIG. 2, the water from the water pipe 91A could flow into the drain tube 70. The on-off state of the drain tube 22 may be controlled so as to allow the water to flow out or not. In an "on" state, water flows from the water-inlet portion 63 to the water-outlet portion 82 of the bushing 60.

Referring to FIG. 2A, the bushing 60 may comprise a first slope 53 between the water-inlet portion 63 and the protruding portion 52. The bushing 60 may comprise a second slope 83 between the water-outlet portion 82 and the protruding portion 52. The protruding portion 52 comprises a smooth surface 52*b* between the first slope 53 and the second slope 83.

Figure 6:
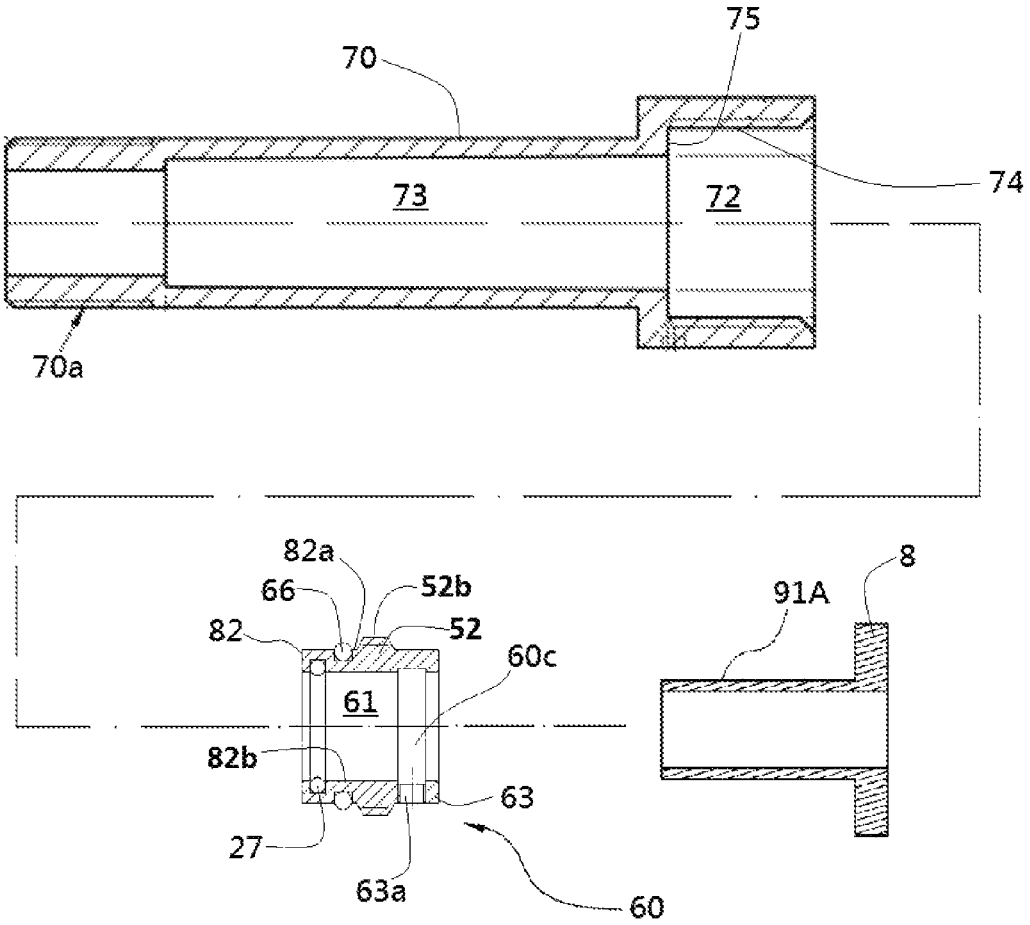
FIG. 6 is a schematic cross-sectional view of a drain tube, a bushing and a water tube according to the second preferred embodiment of the present invention.

FIG. 6 is a schematic cross-sectional view of a drain tube, a bushing and a water tube according to the second preferred embodiment of the present invention. Referring to FIG. 6, the water-outlet portion 82 may have an outer surface 82*a* and an inner surface 82*b*.

Referring to FIG. 6 and FIG. 2A, the bushing 60 may comprise a first ring groove 88 formed in the outer surface 82*a* of the water-outlet portion 82. The depth of the first ring groove 88 may be about 1.7 mm. The width of the first ring groove 88 may be about 2.6 mm. The bushing 60 may comprise a first ring member 66 positioned in the first ring groove 88. The first ring member 66 is not adjacent to the second slope 83, the smooth surface 52*b* or th slope 53 of the protruding portion 52. The first ring member 66 in the first ring groove 88 may be partially exposed.

The material of the first ring member 66 may be rubber. The first ring member 66 may be an O-ring. The bushing 60 may comprise a second ring groove 84 formed in the inner surface 82*b* of the water-outlet portion 82. The second ring groove 84 is not in the protruding portion 52. The second ring groove 84 is not in the second slope 83.

The bushing 60 may comprise a second ring member 27 positioned in the second ring groove 84. The second ring groove 84 may have a depth of about 1.45 mm. The second ring groove 84 may have a width of about 2.6 mm. The material of the second ring member 27 may be rubber.

FIG. 6 is a schematic cross-sectional view of a drain tube, a bushing and a water tube according to the second preferred embodiment of the present invention. Referring to FIG. 2A and FIG. 6, the drain tube 70 may have a first opening 72 and a second opening 73 extending coaxially from the first opening 72. The busing 60 is set at the first opening 72 of the drain tube 70. The first opening 72 is larger in diameter that the second opening 73 of the drain tube 70.

Referring to FIG. 6, the faucet assembly may comprise a step portion 75 defined between the first opening 72 and the second opening 73. The water-outlet portion 82 of the main body 61 may be adjacent to or may abut against the step portion 75. The first opening 72 has an inner side 74 adjacent to the step portion 75. The first ring member 66 may be adjacent to the inner side 74 of the first opening 72.

Figure 5:
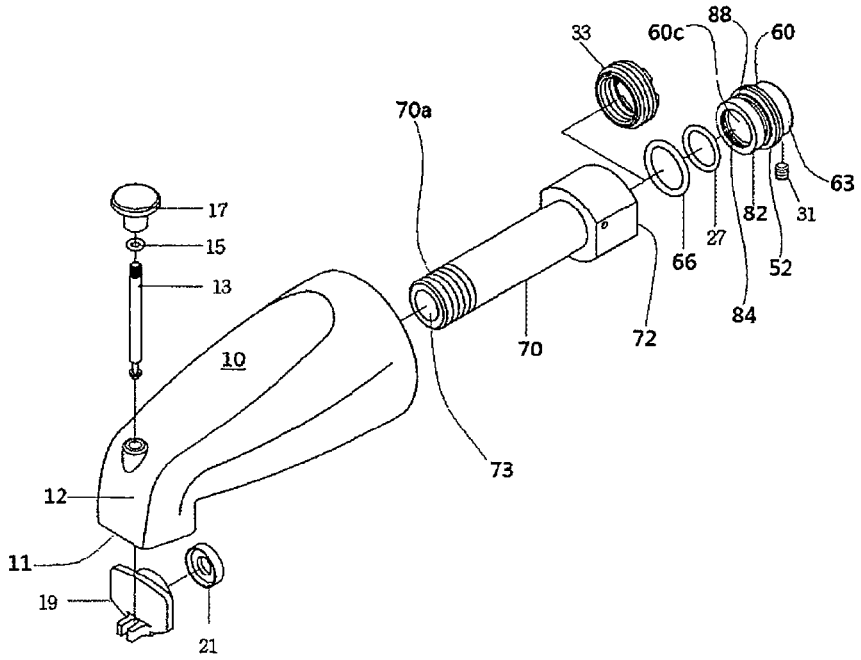
FIG. 5 is a three-dimensional schematic diagram of a drain tube, a bushing and a case according to the second preferred embodiment of the present invention.

FIG. 5 is a three-dimensional schematic diagram of a drain tube, a bushing and a case according to the second preferred embodiment of the present invention. Referring to FIG. 2A and FIG. 5, the bushing 60 may further comprise a through opening 60*c* and a threaded hole 63*a* formed on the water-inlet portion 63 of the main body 62.

Referring to FIG. 6 and FIG. 5, the threaded hole 63*a* communicates with the through opening 60*c*. The bushing 60 may further comprise a screw 31 screwed into the threaded hole 63 (FIG. 6) until the screw 31 abuts against the water pipe 91A (FIG. 2), so as to tighten one portion of the water pipe 91A in the bushing 60.

Referring to FIG. 2A, the water-outlet portion 82 and the water-inlet portion 63 may have the same thickness of about but not limited to about 22.3 millimeters (mm). The protruding portion 52 may be thicker than both of the water-inlet portion 63 and the water-outlet portion 82 of about but not limited to 3.6 mm. That is also one reason why the protruding portion 52 called "protruding" portion 52. The thickness of the protruding portion 52 may be about 25.9 mm.

Referring to FIG. 5, the faucet assembly further comprises a knob 17 being movable to control an on-off state of the drain tube. The material of the knob 17 is, for example, ZINC or Zinc alloy. The faucet assembly may further comprise a rod 13. The material of the rod 13 is, for example, copper. The O-ring 15 may be installed between the knob 17 and the rod 13.

Referring to FIG. 2 and FIG. 5, the faucet assembly may further comprise a knob being movable to control an on-off state of the drain tube. In an "on" state of the drain tube 70, water flows from the water pipe 91A, through water pipe to the exit 11 of the case 10. In an "off" state of the drain tube 70, water does not flow.

Referring to FIG. 5, The water from the water pipe could flow into the drain tube 70. The knob 17 could control the on-off state of the drain tube 22 so as to allow the water to flow out or not. The rod 13 is assembled at a bottom end of the knob 17. The rod 13 is inserted from a top side of the case 10 into the case 10. The faucet assembly may further comprise a gate 19 and a gate washer 21 in the exit 11. The material of the case 10 is, for example, ZINC or zinc alloy. The material of exit 11 is, for example, zinc alloy. The material of the gate washer 21 may be rubber. The material of the gate 19 is, for example, polyoxymethylene (POM).

Referring to FIG. 2A, the bushing 60 may further comprise a third ring groove 63*b*. The depth of the third ring groove 63*b* may be about 10.4 mm. The third ring groove 63*b* may have a width of about 4 mm.

Figure 3:
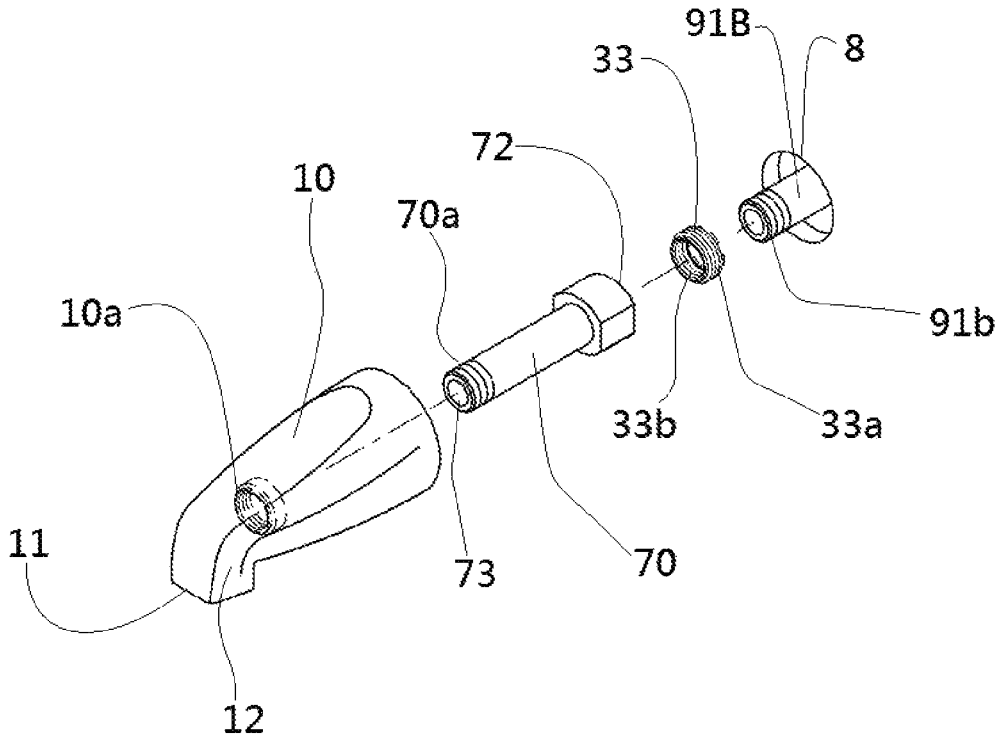
FIG. 3 is a three-dimensional schematic diagram of a faucet assembly according to a third preferred embodiment of the present invention.

FIG. 3 is a three-dimensional schematic diagram of a faucet assembly according to a third preferred embodiment of the present invention. Referring to FIG. 3, the faucet assembly may comprise a case 10, a drain tube 70, and a bushing 33. The drain tube 70 may be assembled in the case 10. The drain tube 10 may have a first opening 72 and a second opening 73 extending coaxially from the first opening 72. The first opening 72 may be larger in diameter that the second opening 73 of the drain tube 70. The bushing 33 may be set at the first opening 72 of the drain tube. The bushing 33 may be assembled to a water pipe 91B extending from a wall 8. The case 10 may have an exit 11 at a front end 12 thereof.

Referring to FIG. 3, the faucet assembly may further comprise a female thread 10*a* formed at a front end of the case 10. the faucet assembly may further comprise a male thread 70*a* may be formed at an end of the drain tube 70. The female thread 10*a* of the case 10 may be screwed to the male thread 70*a* of the drain tube 70. The second opening 73 of the drain tube 70 may be connected to the exit 11 by screwing the female thread 10*a* of the case to the male thread 70*a* of the drain tube 70.

Referring to FIG. 3, the bushing 33 may, for example, have a male thread 33*a* thereon and a female thread 33*b* therein. The bushing 33 may be assembled in the first opening 72 of the drain tube 70. The material of the bushing 33 may be, for example, polyoxymethylene (POM).

Referring to FIG. 3, a water pipe 91B may be assembled in the drain tube 70. The length of water pipe 91B outside the wall 8 may be, for example, about ½ inches. A male thread 91*b* may be formed at an end of the water pipe 91B. The water pipe 91B may have a size of about ½ inches. The female thread 10*a* of the water pipe 91B may be screwed to the bushing 33. The bushing 33 may be assembled to the water tube 91B and surrounded by the first opening 72 of the drain tube 70.

Figure 4:
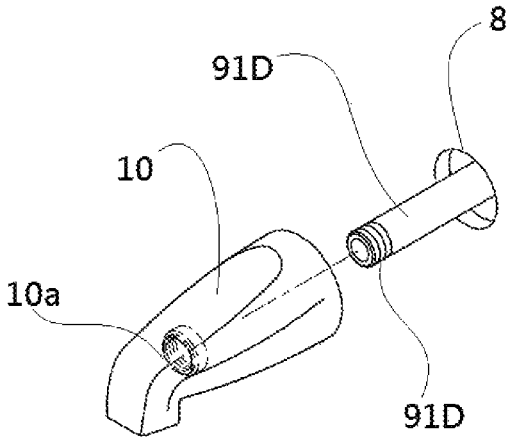
FIG. 4 is a three-dimensional schematic diagram of a faucet assembly according to a fifth preferred embodiment of the present invention.

FIG. 4 is a three-dimensional schematic diagram of a faucet assembly according to a fifth preferred embodiment of the present invention. Referring to FIG. 4, the faucet assembly comprises a case 10 and a female thread 10*a* formed at a front end of the case 10. A water pipe 91D may be assembled in case 10. The length of water pipe 91D outside the wall 8 may be, for example, about 3⅞ inches. A male thread 91*d* may be formed at an end of the water pipe 91D. The water pipe 91D may have a size of about ½ inches.

The female thread 10*a* of the water pipe 91D may be screwed to the male thread 10*a* of the case 10.

According to the preferred embodiments, the faucet assembly and the bushing thereof are all suitable for a water pipe to be connected.

It is understood that the various embodiments described herein are by way of example only and are not intended to limit the scope of the invention. For example, many of the materials and structures described herein may be substituted with other materials and structures without deviating from the spirit of the invention. The present invention as claimed may therefore include variations from the particular examples and preferred embodiments described herein, as will be apparent to one of skill in the art. It is understood that various theories as to why the invention works are not intended to be limiting.

What is claimed is:

1. A bushing set at a drain tube having a first opening and a second opening extending coaxially from the first opening, the bushing comprising:

a main body having a through opening formed therethrough to be assembled to a water pipe, the main body comprising a water-inlet portion, a water-outlet portion, and a protruding portion between the water-inlet portion and the water-outlet portion;

the protruding portion being thicker than both of the water-inlet portion and the water-outlet portion of the main body;

the water-outlet portion having an outer surface and an inner surface; and a step portion being defined between the first opening and the second opening of the drain tube, wherein the water-outlet portion of the main body is adjacent to the step portion.

2. The bushing of claim 1, further comprising a first slope between the water-inlet portion and the protruding portion.

3. The bushing of claim 1, further comprising a second slope between the water-outlet portion and the protruding portion.

4. The bushing of claim 1, further comprising a first ring groove formed in the outer surface of the water-outlet portion.

5. The bushing of claim 4, further comprising a first ring member positioned in the first ring groove.

6. The bushing of claim 1, further comprising a second ring groove formed in the inner surface of the water-outlet portion.

7. The bushing of claim 6, further comprising a second ring member positioned in the second ring groove.

8. The bushing of claim 1, wherein the busing is set at the first opening of the drain tube.

9. The bushing of claim 1, wherein the first opening is larger in diameter that the second opening of the drain tube.

10. The bushing of claim 1, wherein the first opening has an inner side adjacent to the step portion.

11. The bushing of claim 10, wherein the first ring member is adjacent to the inner side of the first opening.

12. A faucet assembly comprising:

a case, a drain tube and a bushing, the drain tube assembled in the case, the drain tube having a first opening and a second opening extending coaxially from the first opening, the bushing set at the first opening of the drain tube, the bushing assembled to a water pipe extending from a wall, the case having an exit at a front end thereof, the second opening of the drain tube connected to the exit, wherein, the bushing comprises:

a main body having a through opening formed therethrough to be assembled to a water pipe, the main body comprising a water-inlet portion, a water-outlet portion, and a protruding portion between the water-inlet portion and the water-outlet portion;

the protruding portion being thicker than both of the water inlet portion and the water-outlet portion of the main body;

the water-outlet portion having an outer surface and an inner surface; and a step portion being defined between the first opening and the second opening of the drain tube, wherein the water-outlet portion of the main body is adjacent to the step portion.

13. The faucet assembly of claim 12, further comprising a threaded hole formed on the water-inlet portion of the main body.

14. The faucet assembly of claim 12, wherein the water-outlet portion and the water-inlet portion have the same thickness.

15. The faucet assembly of claim 12, wherein the protruding portion is thicker than both of the water-inlet portion and the water-outlet portion of about 3.6 mm.

16. The faucet assembly of claim 12, further comprising a knob being movable to control an on-off state of the drain tube.

* * * * *